US012352140B2

(12) United States Patent
Perrucci et al.

(10) Patent No.: US 12,352,140 B2
(45) Date of Patent: Jul. 8, 2025

(54) GAS LIFT SYSTEM AND METHOD

(71) Applicant: Schlumberger Technology Corporation, Sugar Land, TX (US)

(72) Inventors: Lucas Antonio Perrucci, Taubate (BR); Felipe Bauli Graziano, Taubate (BR); Cassius Alexander Elston, Taubate (BR); Eduardo Scussiato, Taubate (BR); Helen Aguiar, Taubate (BR); Jair Osmar de Oliveira Junior, Taubate (BR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/647,528

(22) Filed: Apr. 26, 2024

(65) Prior Publication Data

US 2024/0360743 A1 Oct. 31, 2024

Related U.S. Application Data

(60) Provisional application No. 63/498,621, filed on Apr. 27, 2023.

(51) Int. Cl.
*E21B 43/12* (2006.01)
*E21B 34/06* (2006.01)

(52) U.S. Cl.
CPC ..... *E21B 43/123* (2013.01); *E21B 34/066* (2013.01)

(58) Field of Classification Search
CPC ..... E21B 43/123; E21B 34/066
USPC ..... 166/372
See application file for complete search history.

(56) References Cited

U.S. PATENT DOCUMENTS

| | | | | |
|---|---|---|---|---|
| 6,148,843 | A * | 11/2000 | Pringle | E21B 43/123 137/155 |
| 7,213,607 | B2 * | 5/2007 | De Almeida | E21B 23/03 137/155 |
| 11,585,193 | B1 * | 2/2023 | Hunt | E21B 43/123 |
| 2010/0108326 | A1 | 5/2010 | Messick et al. | |
| 2013/0025875 | A1 | 1/2013 | Critsinelis et al. | |
| 2016/0290099 | A1 | 10/2016 | Balasubramanian | |
| 2018/0149002 | A1 * | 5/2018 | Murdoch | E21B 47/06 |
| 2021/0172300 | A1 | 6/2021 | Rodger | |
| 2022/0145735 | A1 * | 5/2022 | Bisset | E21B 23/03 |
| 2022/0220834 | A1 | 7/2022 | Brown et al. | |
| 2024/0352837 | A1 * | 10/2024 | Brown | E21B 34/066 |

OTHER PUBLICATIONS

Search Report and Written Opinion of International Application No. PCT/US2024/026388 dated Aug. 22, 2024, 9 pages.

* cited by examiner

*Primary Examiner* — Taras P Bemko
(74) *Attorney, Agent, or Firm* — Jeffrey D. Frantz

(57) ABSTRACT

An electric gas lift valve may comprise a side pocket mandril. The side pocket mandril may comprise a side pocket, a top thread connection, and a bottom thread connection. The side pocket may accommodate one or more block valves, a linear electric mechanical actuator (EMA), and electronics. The one or more block valves may be configured to carry a case of a housing, a governor, a cam sleeve, a torsion spring, one or more venturis, one or more dynamic seals, and a solenoid. The electric gas lift valve may provide for an adjustable discrete flow rate control.

20 Claims, 4 Drawing Sheets

GAS LIFT SYSTEM AND METHOD

CROSS-REFERENCE TO RELATED APPLICATIONS

The present application claims the benefit of U.S. Provisional Application No. 63/498,621, filed Apr. 27, 2023, the entirety of which is incorporated by reference herein and should be considered part of this specification.

BACKGROUND

Field

The present disclosure generally relates to gas lift systems.

SUMMARY

An electric gas lift valve may comprise a side pocket mandril. The side pocket mandril may comprise a side pocket, a top thread connection, and a bottom thread connection. The side pocket may accommodate one or more block valves, a linear electric mechanical actuator (EMA), and electronics. The one or more block valves may be configured to carry a case of a housing, a governor, a cam sleeve, a torsion spring, one or more venturis, one or more dynamic seals, and a solenoid. The electric gas lift valve may provide for an adjustable discrete flow rate control.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
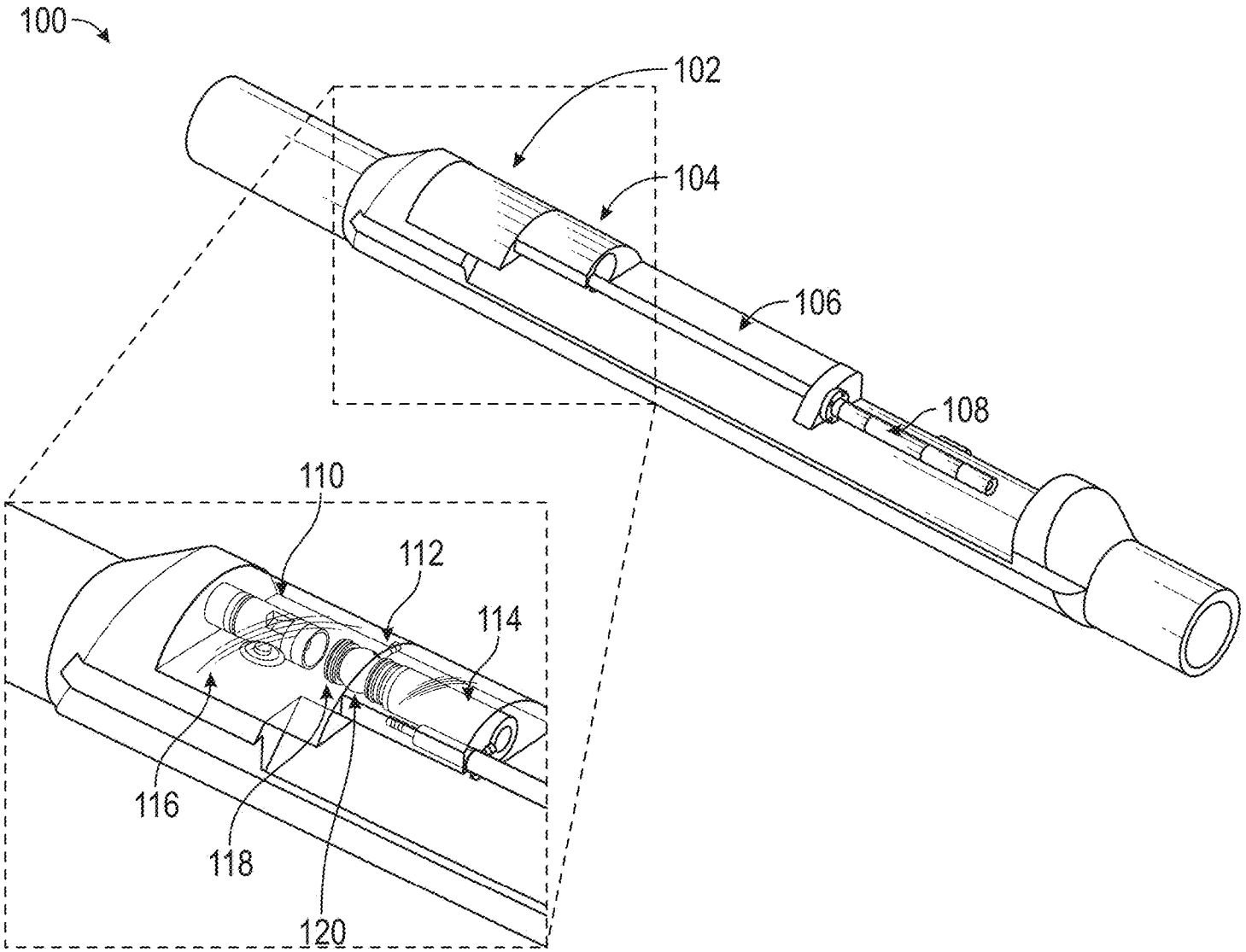
FIG. 1 shows a schematic of a side pocket mandril.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

The oil industry has utilized gas lift to produce hydrocarbon or other fluids for decades. In general, a gas lift valve is installed as part of a gas-lift system and aims to control the flow of lift gas into the production tubing conduit. Gas lift systems aid or increase production by injecting high-pressure gas from the casing annulus into fluids that have entered the production tubing from the formation. The injected gas reduces the fluid density and, thus, the hydrostatic pressure of the fluid, allowing in situ reservoir pressure to lift the lightened liquids.

In embodiments, a gas-lift valve is located in the gas-lift mandril, which also provides communication with the lift gas supply in the tubing annulus. Gas lift valves can be adjusted by operators to control the rate of gas injection into the liquid column in the production tubing. Check valves within the gas lift valves can be used to control the fluid flow in only one direction—from the casing annulus into the production tubing. When the gas flow rate is required to be adjusted due to a new condition of the well, a well intervention operation is required to exchange the orifice size from the gas lift valve.

In embodiments, an electric gas lift valve can be used in a gas lift system. Electricity can be supplied to the valve and be used to actuate the valve in their function remotely, without the need to intervene in the well. In addition, the electric power can enable other functions such as detecting and monitoring the open and close of the valve as well as pressure, temperature, vibration, and flow rates, which are valuable data to the well operator.

FIG. 1 below shows a side pocket mandril 100 having a top and bottom industry thread connection, allowing it to be in line connected with the production string. The mandril 100 may comprise a housing 102, block valves 104, mandril 106, linear electric mechanical actuator (EMA) 108, back-check valve 110, venturi 112, cam sleeve 114, housing 116, dynamic seals 118, and a governor 120. The external side pocket accommodates the block of the valves, the linear electric mechanical actuator, and the electronics to control the same. The block of valves carries the components of the valve as the case of the housing itself, governor, cam sleeve, torsion spring, venturis, dynamic seals, solenoid and back-check. The housing of the electric mechanical actuator, fully fixed constrained in the mandril, makes the stem to move axially, actuating the valve inside of the block of valves.

Figure 2:
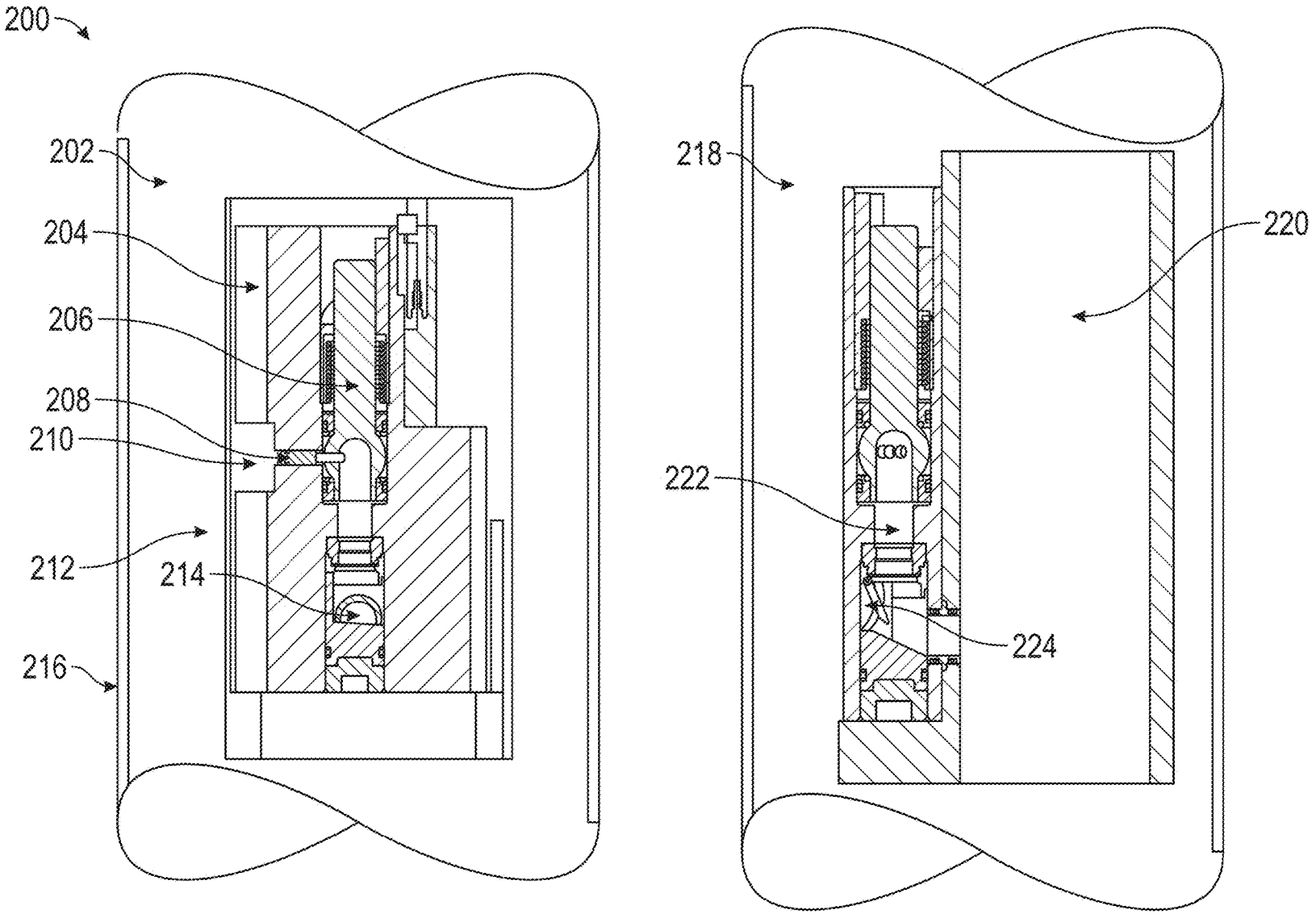
FIG. 2 shows the function of the aperture and closure of the valve.

Represented by the cross-section view of an embodiment, FIG. 2 below illustrates the function of the aperture and closure of the valve. This section of the system 200 may comprise an annulus 202, block of valves 204, governor 206, venturi 208, gas entrance 210, mandril 212, gas flow path 214, and casing 216, annulus 218, tubing 220, gas flow path 222, and flapper backcheck 224. The gas coming from annulus reach the multiple venturis. The block of valves fits multiple venturis and where the gas passing through it, limit the amount of gas that can get in due to the size of the related venturis. The governor is the next part which the gas comes across. In embodiments, it has a lower half physiognomy shaped like a sphere, hollow inside and a pattern of radial through holes, allowing the gas to pass through the entire thickness of the governor, reaching the internal of the valve.

Figure 3:
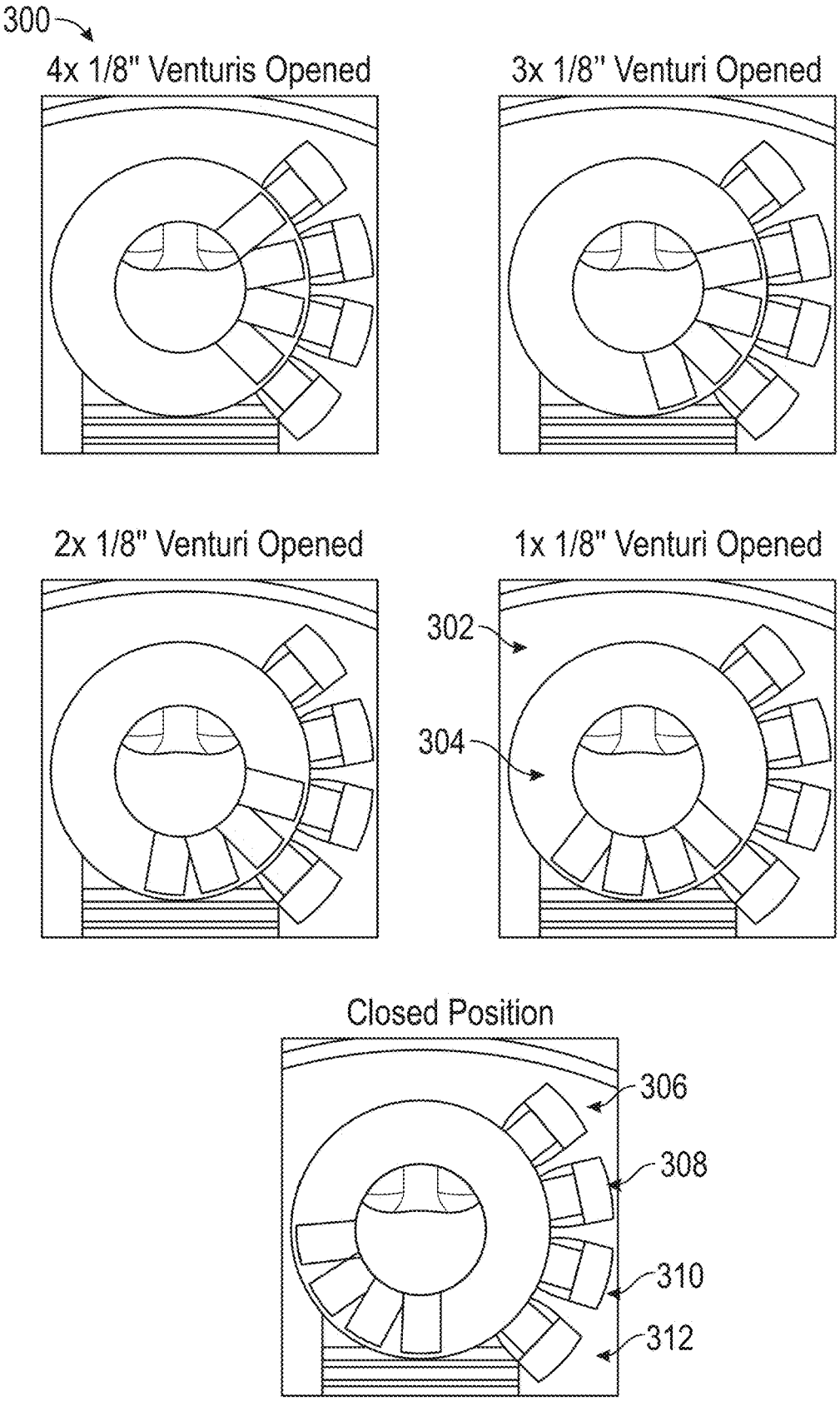
FIG. 3 shows the governor rotation in relation to the block of valves.

As shown in FIG. 3 below, as the governor rotates in relation to the block of valves, it allows the multiple radial holes to switch positions in regards to the multiple venturis. This mechanism 300 may comprise block valves 302, governor 304, first venturi 306, second venturi 308, second-end venturi 310, and first-end venturi 312. With the first signal of rotation in the governor, the first-end radial hole becomes misaligned with the first-end venturi 312, blinding the first venturi 306, and consequently reducing the amount of gas entering the valve. As the governor switched the angular position, the second-end radial hole is now aligned with the first-end venturi 312. As the rotation continues, the first-end venturi 312 become misaligned with the second-end radial hole and becomes aligned with the third-end radial hole (blue), blinding the second venturi 308, and consequently reducing the amount of gas entering the valve even more. As the governor switched the angular position once again, the third-end radial hole is now aligned with the first-end venturi 312. This repeats as many venturis exist in the block of valve until all of them become closed and consequently interrupting the passage of gas completely. As there is an individual sealing mechanism in each of the interface between the venturi and the through hole of the governor, a gas tight sealing is provided.

When the valve is full open, all radial holes aligned with their respective venturis. When the valve is partially open, only some of the venturis are aligned with the radial holes and some others are blinded as above explained. Either way, the gas continues flowing inside the valve passing through the backcheck and finally reaching the production tubing, as shown in FIG. 2 above.

Figure 4:
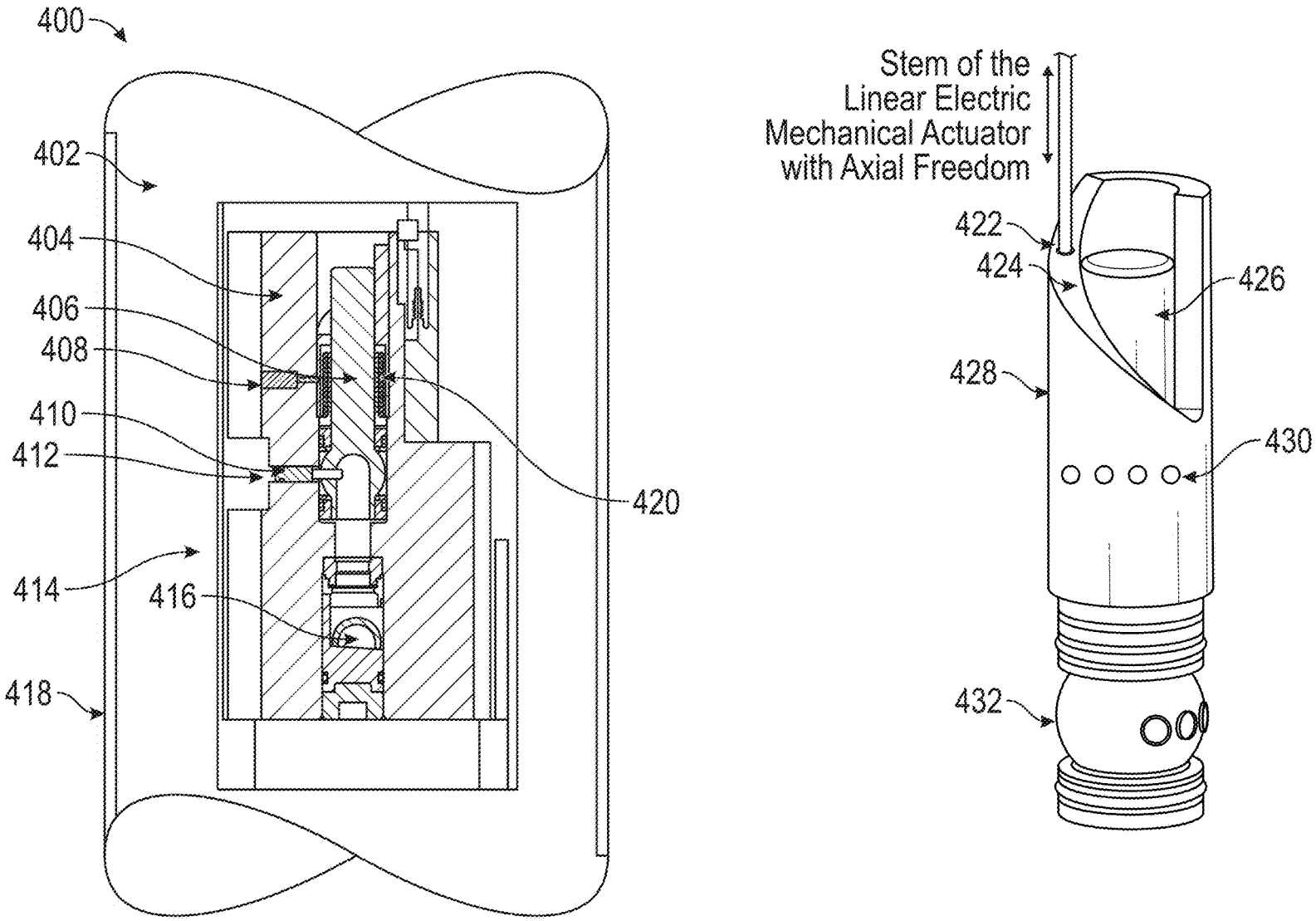
FIG. 4 shows a torsion spring being used to vest the upper half section of the governor.

In FIG. 4 below, a torsion spring can be used to vest the upper half section of the governor, with one of its ends being attached to the block of valves and the another of its end being attached to the governor. The system 400 in FIG. 4, may comprise annulus 402, block valves 404, governor 406, solenoid 408, venturi 410, gas entrance 412, mandril 414, gas flow path 416, casing 418, torsional spring 420, stem tip 422, ramped run track 424, cam sleeve 428, governor 432, governor 426, and indexing holes 430. The stem of the linear EMA may have axial freedom. A cam sleeve can be fully fixed and constrained in the upper half section of the governor, turning with the governor when required. The top surface of the cam sleeve has a ramped run track that interfaces with the end tip of the stem of the linear electric mechanical actuator. As the stem moves downwards, towards the sleeve, the sleeve and the governor are forced to rotate and, at the same time, loading force in the torsion spring. This rotation makes the radial through holes of the governor to align and misalign from the multiple venturis as above explained. Analogy with the stepwise rotation, a plurality of indexing holes made in the outer face of the cam sleeve also synchronizes with a normally closed and spring-loaded solenoid. The solenoid when expanded can retain the angular position of the cam sleeve as well as of the governor and consequently, keeping the configuration of the aperture of the valve.

In embodiments, the solenoid is expanded in an electrically powered condition. This means that in case electricity is lost or interrupted intentionally, the solenoid will retract by the action of its spring and, instantly after, the accumulated energy in the torsion spring will be released, returning the governor to the default condition where all of its through radial holes are aligned with the venturis, where the valve is full open.

The current disclosure provides multiple advantages compared to traditional gas lift valves. For example, the fail open valve in the direction of annulus to tubing, allowing to inject gas into the well at any circumstance of electrical. Moreover, because of the autonomous backcheck valve, the valve is also failed close in the direction of tubing to annulus, maintaining the integrity of the well at any circumstance of electrical failure. The novel function of opening and closing the passage of the gas in the valve, electrically commanded for the surface, eliminating the need of well intervention maneuver as happen nowadays installing or removing dummy valve in the mandril. The novel function of gas flow control in the valve, electrically commanded for the surface, eliminating the need of well intervention maneuver as happen nowadays exchanging the orifice size of the valve.

In embodiments, a single linear electric mechanical actuator can be used to control the flow and the opening and closing of the gas in the valve. This increases system reliability due to the single motor actuating both function of the valve, as being the open & close and flow control of the gas. The system reliability is also increased by the fact of using rotational sealing mechanisms which have better performance against scale and debris.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An electric gas lift valve system, comprising:

a side pocket mandril comprising a side pocket, a top thread connection, and a bottom thread connection, wherein the side pocket accommodates one or more block valves, a linear electric mechanical actuator (EMA), and electronics, the one or more block valves configured to carry a case of a housing, a governor, a cam sleeve, a torsion spring, one or more venturis, one or more dynamic seals, and a solenoid; and the electric gas lift valve configured for an adjustable discrete flow rate control and to fail, in a case of an electrical failure, in an open position in a direction of an annulus to a tubing, due to the solenoid being configured to retract by a force of the torsion spring.

2. The electric gas lift valve system of claim 1, wherein the gas lift mandril is configured to provide communication with a gas lift supply in the annulus.

3. The electric gas lift valve system of claim 1, further comprising a backcheck valve that is configured to allow flow in one direction from the annulus into the tubing.

4. The electric gas lift valve system of claim 1, wherein the housing, which houses the linear EMA, is fixed to the side pocket mandril, wherein a stem of the linear EMA is configured to move axially, thereby actuating a valve inside of the block of valves.

5. The electric gas lift valve system of claim 1, wherein the governor comprises a lower half physiognomy that is sphere-like and hollow inside with a pattern of radial through holes.

6. The electric gas lift valve system of claim 1, wherein the governor is configured to rotate in relation to the block of valves, allowing multiple radial holes to switch positions with respect to the one or more venturis.

7. The electric gas lift valve system of claim 1, wherein when all the venturis of the one or more venturis in the block of valve are closed, a passage of gas is interrupted.

8. The electric gas lift valve system of claim 1, comprising an individual sealing mechanism in each interface between the one or more venturis and a through hole of the governor in order to provide a gas tight sealing.

9. The electric gas lift valve system of claim 1, wherein the torsion spring vests an upper half section of the governor.

10. The electric gas lift valve system of claim 1, wherein the cam sleeve, fixed in an upper section of the governor, is configured to turn with the governor.

11. The electric gas lift valve system of claim 1, wherein the electric gas lift valve system is configured to fail, in a case of an electrical failure, in a closed position, using a backcheck valve, in a direction of the tubing to the annulus.

12. A method of operating an electric gas valve system, the method comprising:

allowing gas to pass from an annulus to one or more venturis;

limiting an amount of gas passing through multiple venturis with one or more block of valves;

allowing gas to pass through a governor to reach an internal valve;

rotating the governor in relation to the block of valves, thereby allowing multiple radial holes to switch positions in regard to the one or more venturis.

13. The method of operating the electric gas valve system of claim 12, wherein the governor comprises a lower half physiognomy that is sphere-like and hollow inside with a pattern of radial through holes.

14. The method of operating the electric gas valve system of claim 12, comprising stopping a passage of gas when all the venturis of the one or more venturis in the block of valves are closed.

15. The method of operating the electric gas valve system of claim 12, comprising individually sealing, via an individual sealing mechanism, each interface between the one or more venturis and a through hole of the governor in order to provide a gas tight sealing.

16. The method of operating the electric gas valve system of claim 12, comprising turning the governor with a cam sleeve, wherein the cam sleeve is fixed in an upper section of the governor.

17. The method of operating the electric gas valve system of claim 16, comprising, as a stem of a linear electric mechanical actuator (EMA) moves downwards towards the cam sleeve, rotating the cam sleeve and the governor while at the same time loading force in a torsion spring.

18. The method of operating the electric gas valve system of claim 12, comprising failing, in a case of an electrical failure, the electric gas lift valve system in an open position in a direction of the annulus to a tubing, thus allowing gas injection into a well.

19. The method of operating the electric gas valve system of claim 12, comprising failing, in a case of an electrical failure, the electric gas lift valve system in a closed position, using a backcheck valve, in a direction of a tubing to the annulus.

20. An electric gas lift valve system, comprising:

a side pocket mandril comprising a side pocket, a top thread connection, and a bottom thread connection, wherein the side pocket accommodates one or more block valves, a linear electric mechanical actuator (EMA), and electronics, the one or more block valves configured to carry a case of a housing, a governor, a cam sleeve, a torsion spring, one or more venturis, one or more dynamic seals, and a solenoid; and the electric gas lift valve configured for an adjustable discrete flow rate control, wherein the electric gas lift valve system is configured to fail, in a case of an electrical failure, in a closed position, using a backcheck valve, in a direction of a tubing to an annulus.

* * * * *